US012180741B2

(12) United States Patent
Bozzo Rotondo et al.

(10) Patent No.: US 12,180,741 B2
(45) Date of Patent: Dec. 31, 2024

(54) BUCKLING DELAYED SHEAR LINK

(71) Applicants: Luis Miguel Bozzo Rotondo, Barcelona (ES); Guillermo Bozzo Fernández, Barcelona (ES)

(72) Inventors: Luis Miguel Bozzo Rotondo, Barcelona (ES); Guillermo Bozzo Fernández, Barcelona (ES)

( * ) Notice: Subject to any disclaimer, the term of this patent is extended or adjusted under 35 U.S.C. 154(b) by 242 days.

(21) Appl. No.: 17/967,199

(22) Filed: Oct. 17, 2022

(65) Prior Publication Data

US 2024/0125137 A1 Apr. 18, 2024

(51) Int. Cl.
*E04H 9/02* (2006.01)

(52) U.S. Cl.
CPC ..... *E04H 9/021* (2013.01)

(58) Field of Classification Search
CPC ..... E04H 9/02; E04H 9/021; E04H 9/0215; E04H 9/0237; E04H 9/024; E04H 9/025; E04B 1/36; E04B 1/98
See application file for complete search history.

(56) References Cited

U.S. PATENT DOCUMENTS 4,823,522 A * 4/1989 White ..... E04H 9/023 248/596
4,959,934 A * 10/1990 Yamada ..... E04H 9/0237 52/573.1
5,533,307 A * 7/1996 Tsai ..... E04H 9/0237 52/167.3
5,630,298 A * 5/1997 Tsai ..... E04H 9/021 52/167.3
5,971,347 A * 10/1999 Tsai ..... F16F 15/02 248/618
6,085,471 A * 7/2000 Axon ..... E01D 19/02 52/167.7
6,799,400 B2 * 10/2004 Chuang ..... F16F 7/12 188/371
6,948,284 B2 * 9/2005 Chiang ..... E04H 9/0235 52/167.1
7,290,375 B2 * 11/2007 Kemeny ..... E04H 9/0237 52/167.6

(Continued)

FOREIGN PATENT DOCUMENTS

CN 106193360 A * 12/2016 ..... E04H 9/021
CN 106193752 A * 12/2016 ..... E04H 9/021

(Continued)

*Primary Examiner* — Kyle J. Walraed-Sullivan
(74) *Attorney, Agent, or Firm* — Donald R. Boys; Central Coast Patent Agengy LLC

(57) ABSTRACT

A buckling delayed shear link (BDSL) has a second metal base plate, a first metal base plate, a metal core plate rigidly joined orthogonally to the second metal base plate, an axial relief assembly having matching slip fit channels and extensions, a first restraining assembly restraining one side of the core plate and a second restraining assembly restraining the other side of the core plate. The first metal base plate is enabled to move vertically freely over a distance relative to the rigid assembly of the second metal base plate, the core plate, and the first and second restraining assemblies by virtue of the axial relief assembly, and lateral movement of the first metal base plate relative to the second metal base plate transfers a shear component of force to an upper end of the core plate.

27 Claims, 9 Drawing Sheets

(56) References Cited

U.S. PATENT DOCUMENTS 7,837,380 B2 * 11/2010 Wang ..... F16F 15/067 366/217
7,922,413 B2 * 4/2011 Roth ..... F16B 5/0628 403/59
2001/0054785 A1 * 12/2001 Berton ..... E04H 9/0237 267/136
2003/0047854 A1 * 3/2003 Tsai ..... E04H 9/0237 267/136
2003/0223659 A1 * 12/2003 Lee ..... E04H 9/023 384/36
2004/0000103 A1 * 1/2004 Chen ..... E04H 9/0237 52/167.7
2004/0074723 A1 * 4/2004 Tsai ..... E04H 9/0237 188/371
2008/0283712 A1 * 11/2008 Su ..... E04H 9/0237 248/424
2010/0205876 A1 * 8/2010 Christopoulus ..... E04H 9/024 52/698
2010/0308201 A1 * 12/2010 Su ..... E04H 9/0237 248/564
2012/0138402 A1 * 6/2012 Choi ..... F16F 7/08 188/381
2013/0042546 A1 * 2/2013 Bowlus ..... E04H 9/021 52/167.4
2016/0040739 A1 * 2/2016 Smith ..... E04H 9/024 188/371
2016/0333576 A1 * 11/2016 Bowlus ..... E04H 9/021
2016/0348751 A1 * 12/2016 Cho ..... E04B 1/98
2017/0107734 A1 * 4/2017 Gray ..... E04H 9/0237
2017/0108034 A1 * 4/2017 McGuire ..... F16C 11/0604
2017/0268252 A1 * 9/2017 Gray ..... E04H 9/025
2018/0202151 A1 * 7/2018 Choi ..... E04H 9/027
2018/0334825 A1 * 11/2018 Bonessio ..... F16F 15/073
2019/0136564 A1 * 5/2019 Martín Hernández ..... E04H 9/021
2019/0161990 A1 * 5/2019 Gollapudi ..... E04H 9/021
2020/0348223 A1 * 11/2020 De Jesus ..... G01L 5/0004
2021/0095463 A1 * 4/2021 Jiang ..... F16F 7/00
2021/0164223 A1 * 6/2021 Honarbakhsh ..... E04B 1/98
2022/0290457 A1 * 9/2022 Yang ..... E04H 9/0215
2022/0290458 A1 * 9/2022 Hadad ..... F03G 7/0614

FOREIGN PATENT DOCUMENTS

CN 106639457 A * 5/2017 ..... E04H 9/021
CN 107269752 A * 10/2017 ..... E04H 9/021
CN 107882202 A * 4/2018 ..... E04H 9/021
CN 108049689 A * 5/2018 ..... E04H 9/021
CN 110629899 A * 12/2019 ..... E01D 19/00
CN 111851779 A * 10/2020 ..... E04B 1/98
CN 112160640 A * 1/2021 ..... E02D 27/42
CN 112431321 A * 3/2021 ..... E04B 1/98
CN 112523073 A * 3/2021 ..... E01D 19/02
CN 112832375 A * 5/2021 ..... E04B 1/24
CN 113152717 A * 7/2021 ..... E04B 1/98
KR 1524669 B1 * 6/2015 ..... E04B 1/98
KR 1556333 B1 * 10/2015 ..... E04B 1/98
KR 1578198 B1 * 12/2015 ..... E04B 1/985
KR 1655743 B1 * 9/2016 ..... E04B 1/98
KR 1785877 B1 * 11/2017 ..... E04H 9/021
KR 2018070998 A * 6/2018 ..... E04B 1/98
KR 2018070999 A * 6/2018 ..... E04H 9/021
KR 1888879 B1 * 8/2018 ..... E04H 9/021
KR 2019051324 A * 5/2019 ..... E04H 9/021
KR 2019051325 A * 5/2019 ..... E04H 9/021
KR 2019074051 A * 6/2019 ..... E04H 9/021
KR 2019080588 A * 7/2019 ..... E04B 1/98
KR 2018098 B1 * 9/2019 ..... E04H 9/021
KR 2024061171 A * 5/2024 ..... E01D 19/041
WO WO-2011099816 A2 * 8/2011 ..... E04H 9/02
WO WO-2014069972 A1 * 5/2014 ..... E04B 1/985
WO WO-2015192200 A1 * 12/2015 ..... E04B 1/2403
WO WO-2016064249 A1 * 4/2016 ..... E04B 1/98
WO WO-2016086283 A1 * 6/2016 ..... E04B 1/2403
WO WO-2022011644 A1 * 1/2022 ..... E04B 1/54

* cited by examiner

BUCKLING DELAYED SHEAR LINK

BACKGROUND OF THE INVENTION

1. Field of the Invention

The present invention is in the technical field of seismic dissipation for structures and pertains more particularly to a seismic connecting device that serves both as an energy dissipation device and as a device limiting seismic forces.

2. Description of Related Art

It is well known in the art that earthquake events cause widespread damage to buildings and infrastructure such as highways and bridges, and also cause loss of life and serious injury. Consequently, means of accomplishing earthquake-resistant structures are of great interest in the art of civil engineering.

Conventional seismic design has been based chiefly on ductility and structural redundancy, allowing reducing seismic forces substantially in relation to elastic linear forces, depending on material and the structural system used for lateral load. Such a result is based on a linear elastic response that reduces the seismic forces without taking into account directly non-linear nature of the problem. A well-known system, example of that, is the eccentric brace steel structural system considered by building practice as one of the best. This system, developed by Professor Egor Popov from U.C. Berkeley in the 1970's, also does not take into account directly the non-linear nature of the problem but concentrates the non-linear response of the structure in the shear links between diagonals not concentrically connected. These shear links concentrate most of the energy dissipated by the structure, so protecting it, but they are an integral part of the beams so they are very difficult to remove or to repair after a strong earthquake. Besides they use standard steel shapes and welding for stiffeners that avoid local web buckling so their nature is highly hiperstatic.

During the decade of the 1980s alternatives to conventional seismic design appeared, such as Base Isolation or Energy Dissipators. Base isolation was used principally in low and medium rise buildings and bridges, and functions by introducing an interface between a superstructure and the ground upon which the superstructure rests. Base Isolation is good for protecting low and medium rise structures by enlarging their structural period but is not effectivein high rise buildings and has a high risk of global structural collapse if the system fails.

Among energy dissipators known in the art are, for one, the well-known system ADAS (Adding Damping and Stiffness) developed in 1990 by Scholl. The ADAS system is formed by metal plates in cross form (X) fixed in both sides of the ADAS device and commonly connected to the structure with metal diagonals. The dimensions and number of plates might vary depending on desired energy to dissipate. One ADAS system is the subject of U.S. Pat. No. 4,910,929.

Another ADAS-type system is known as the TADA system (Triangular-plate Adding Damping and Stiffness), developed by Tsai in 1996, it is a similar system to the ADAS, but the plates have a triangular shape, fixed on the top side and articulated on the bottom side. This system is the subject of U.S. Pat. No. 5,533,307.

Another popular seismic protecting device is known as the Buckling Restrained Brace (BRB), which is made of a steel section embedded in a cement material which is also encased in a metal tube. There are two distinct elements in a BRB system, the load carrying element (LCE) and the buckling restraining element (BRE). The LCE and the BRE perform two different but complementary roles. The LCE takes load only and the BRE just has to prevent buckling, not carry any other load. Thus, as the cement and the pipe are only designed to prevent buckling, if they were engaged in taking load they would tend to buckle and the system would not work.

Other known devices are steel or aluminum Buckling Inhibited Shear Panels formed by a dissipative plate and a rigid frame typically bolted to the plate, in order to avoid welding, and to prevent global buckling. The rigid frames in these shear panels limit the deformation capacity of these devices under large displacements, resulting in hysteretic curves with significant pinching and low deformation rates. Another significant difference is related to the hyperstatic nature of these solutions compared to the static determine solution proposed in this invention. The static determined solution proposed without axial force and bending moment at one end has significant analysis and design advantages. A very important advantage is limiting exactly the transferred force to the structure by these devices which is particularly achieved by simple tensile test for each steel plate used to manufacture the devices and modifying their dimensions according to it.

Shear Link Bozzo (SLB) dissipators appeared during the early 2000s. These dissipators work mainly through shear thanks to a height to width ratio working in their own stiff plane. Besides the dissipative areas are without welding. SLB devices have evolved over the years since the early 2000s, but always follow the same working principle of dissipating energy through metal yielding being extremely stiff and start dissipating energy at displacements as low as 0.2 mm.

What is clearly needed is a new generation of shear dissipating devices in order to prevent or delay the global and local instabilities to reach large deformation and larger dissipated energy knowing precisely the interacting force between the structure and the devices. The present generation has very limited deformation capabilities since global and local instabilities do not allow overpassing certain relatively low deformation values as several tests have shown. Furthermore, axial force transfer in the conventional device limits their deformation and dissipation of energy capabilities and makes the analysis and design process much more complex.

BRIEF SUMMARY OF THE INVENTION

In one embodiment of the invention a buckling delayed shear link (BDSL) is provided, comprising a lower metal base plate having a length and a width in a horizontal plane and upper and lower parallel surfaces, an upper metal base plate having a length and a width in a horizontal plane and upper and lower parallel surfaces, a metal core plate having a width and a height and a thickness between first and second parallel surfaces, rigidly joined orthogonally to the lower base plate, an axial relief assembly having a first horizontal plate with a vertical extension having a specific horizontal cross section and a second horizontal plate with a vertical channel having the same horizontal cross section as the vertical extension of the first horizontal plate, the vertical extension engaged in the vertical channel, one of the first and the second horizontal plates joined rigidly to an underside of the upper base plate, and the other of the first and the second base plate joined rigidly to an upper edge of the core plate, a first restraining assembly having a first vertically oriented restraining plate with a first surface closely proximate to the first parallel surface of the core plate, and a first buttress plate joined rigidly by a vertical edge orthogonally to the first vertically oriented restraining plate and by a lower edge to the upper parallel surface of the lower base plate, and a second restraining assembly having a second vertically oriented restraining plate with a second surface closely proximate to the second parallel surface of the core plate, and a second buttress plate joined rigidly by a vertical edge orthogonally to the second vertically oriented restraining plate and by a lower edge to the upper parallel surface of the lower base plate. The upper base plate is enabled to move vertically freely over a distance relative to the rigid assembly of the lower base plate, the core plate, and the first and second restraining assemblies by virtue of the axial relief assembly, and lateral movement of the upper base plate relative to the lower base plate transfers a shear component of force to an upper end of the core plate.

In one embodiment the BDSL further comprises a first milled area of a specific shape to a first depth on one parallel surface of the core plate and a second milled area of the same specific shape and depth directly on the opposite parallel surface of the core plate, resulting in a web of the specific shape, having the thickness of the core plate less twice the depth of the milled areas. Also, in one embodiment the BDSL comprises two or more webs in milled areas at different locations on the core plate. In one embodiment the BDSL further comprises a first button extension from the web on one side of the web, presenting a flat surface closely proximate to the surface of the restraining plate on that side of the web, and a second button extension on an opposite side of the web, presenting a flat surface closely proximate to the surface of the restraining plate on the opposite side of the web. And in one embodiment the BDSL further comprises additional button extensions on opposite sides of different webs of the core plate, each extending a flat surface closely proximate to the surfaces of the restraining plate.

In one embodiment the BDSL further comprises a first button extension from the first restraining plate extending into the first milled area, presenting a flat surface closely proximate to the surface of the web, and a second button extension from the second restraining plate extending into the second milled area, presenting a flat surface closely proximate to the surface of the web, the button extensions from the restraining plates restraining the web from local buckling deformation. Also, in one embodiment to BDSL further comprises additional button extensions on surfaces of the restraining plates, each extending a flat surface closely proximate to the surfaces of the webs. Also, in one embodiment an axial relief assembly comprises a first horizontal plate with a plurality vertical extensions each having a specific horizontal cross section and a second horizontal plate with a plurality of vertical channels, equal to the number of vertical extensions, each channel having the same horizontal cross section as the vertical extensions of the first horizontal plate, the vertical extensions engaged in the vertical channels, with one of the first and the second horizontal plates joined rigidly to an underside of the upper base plate, and the other of the first and the second base plate joined rigidly to an upper edge of the core plate. In one embodiment the metal of the core plate is either stainless steel or aluminum. And in one embodiment the BDSL further comprises a plurality of buttress plates in each restraining assembly, the buttress plates rigidly joined to the lower base plate and to the restraining plates in a manner that the restraining plates are held above the lower base plate, providing clearance for cleaning.

In another aspect of the invention a method for dissipating energy in a building structure in a seismic event is provided, comprising creating a plurality of buckling delayed shear link (BDSL) devices each having a lower metal base plate having a length and a width in a horizontal plane and upper and lower parallel surfaces, an upper metal base plate having a length and a width in a horizontal plane and upper and lower parallel surfaces, a metal core plate having a width and a height and a thickness between first and second parallel surfaces, rigidly joined orthogonally to the lower base plate, an axial relief assembly having a first horizontal plate with a vertical extension having a specific horizontal cross section and a second horizontal plate with a vertical channel having the same horizontal cross section as the vertical extension of the first horizontal plate, the vertical extension engaged in the vertical channel, one of the first and the second horizontal plates joined rigidly to an underside of the upper base plate, and the other of the first and the second base plate joined rigidly to an upper edge of the core plate, a first restraining assembly having a first vertically oriented restraining plate with a first surface closely proximate to the first parallel surface of the core plate, and a first buttress plate joined rigidly by a vertical edge orthogonally to the first vertically oriented restraining plate and by a lower edge to the upper parallel surface of the lower base plate, and a second restraining assembly having a second vertically oriented restraining plate with a second surface closely proximate to the second parallel surface of the core plate, and a second buttress plate joined rigidly by a vertical edge orthogonally to the second vertically oriented restraining plate and by a lower edge to the upper parallel surface of the lower base plate, and installing individual ones of the BDSL devices vertically between constituent members of a building structure, the upper base plate of the BDSL devices joined rigidly to one of the constituent members and the lower base plate joined rigidly to the other of the two constituent members, such that the upper base plates are enabled to move vertically freely over a distance relative to the rigid assembly of the lower base plates, the core plates, and the first and second restraining assemblies by virtue of the axial relief assemblies, and lateral movement of the upper base plates relative to the lower base plates transfers a shear component of forces to an upper end of the core plates, the force resulting in deformation of the core plates.

In one embodiment the method further comprises, in the creating action, machining a first milled area of a specific shape to a first depth on one parallel surface of the core plate of each device and a second milled area of the same specific shape and depth directly on the opposite parallel surface of the core plate of each device, resulting in webs of the specific shape, having the thickness of the core plate less twice the depth of the milled areas. Also, in one embodiment the method comprises creating two or more webs in milled areas at different locations on the core plates. In one embodiment the method further comprises machining, in the creating action, a first button extension from the webs on one side of the webs, the extension presenting a flat surface closely proximate to the surface of the restraining plates on that side of the web, and a second button extension on an opposite side of the webs, presenting a flat surface closely proximate to the surface of the restraining plates on the opposite side of the webs. And in one embodiment the method further comprises implementing additional button extensions on opposite sides of different webs of the core plate, each extending a flat surface closely proximate to the surfaces of the restraining plate.

In one embodiment the method further comprises implementing a first button extension from the first restraining plate of each BDSL device, extending into the first milled area, presenting a flat surface closely proximate to the surface of the web, and a second button extension from the second restraining plate of each BDSL device extending into the second milled area, presenting a flat surface closely proximate to the surface of the web, the button extensions from the restraining plates restraining the webs from local buckling deformation. Also, in one embodiment the method further comprises implementing additional button extensions on surfaces of the restraining plates of each BDSL device, each extending a flat surface closely proximate to the surfaces of the webs. Also, in one embodiment the method comprises implementing the axial relief assembly with a first horizontal plate having a plurality vertical extensions each having a specific horizontal cross section and a second horizontal plate with a plurality of vertical channels, equal to the number of vertical extensions, each channel having the same horizontal cross section as the vertical extensions of the first horizontal plate, engaging the vertical extensions engaged in the vertical channels, and joining one of the first and the second horizontal plates rigidly to an underside of the upper base plate, and joining the other of the first and the second base plate rigidly to an upper edge of the core plate. In one embodiment the method comprises making the core plates from either stainless steel or aluminum. And in one embodiment the method further comprises implementing a plurality of buttress plates in each restraining assembly, the buttress plates rigidly joined to the lower base plates and to the restraining plates in a manner that the restraining plates are held above the lower base plates, providing clearance for cleaning.

DETAILED DESCRIPTION OF THE INVENTION

Figure 1:
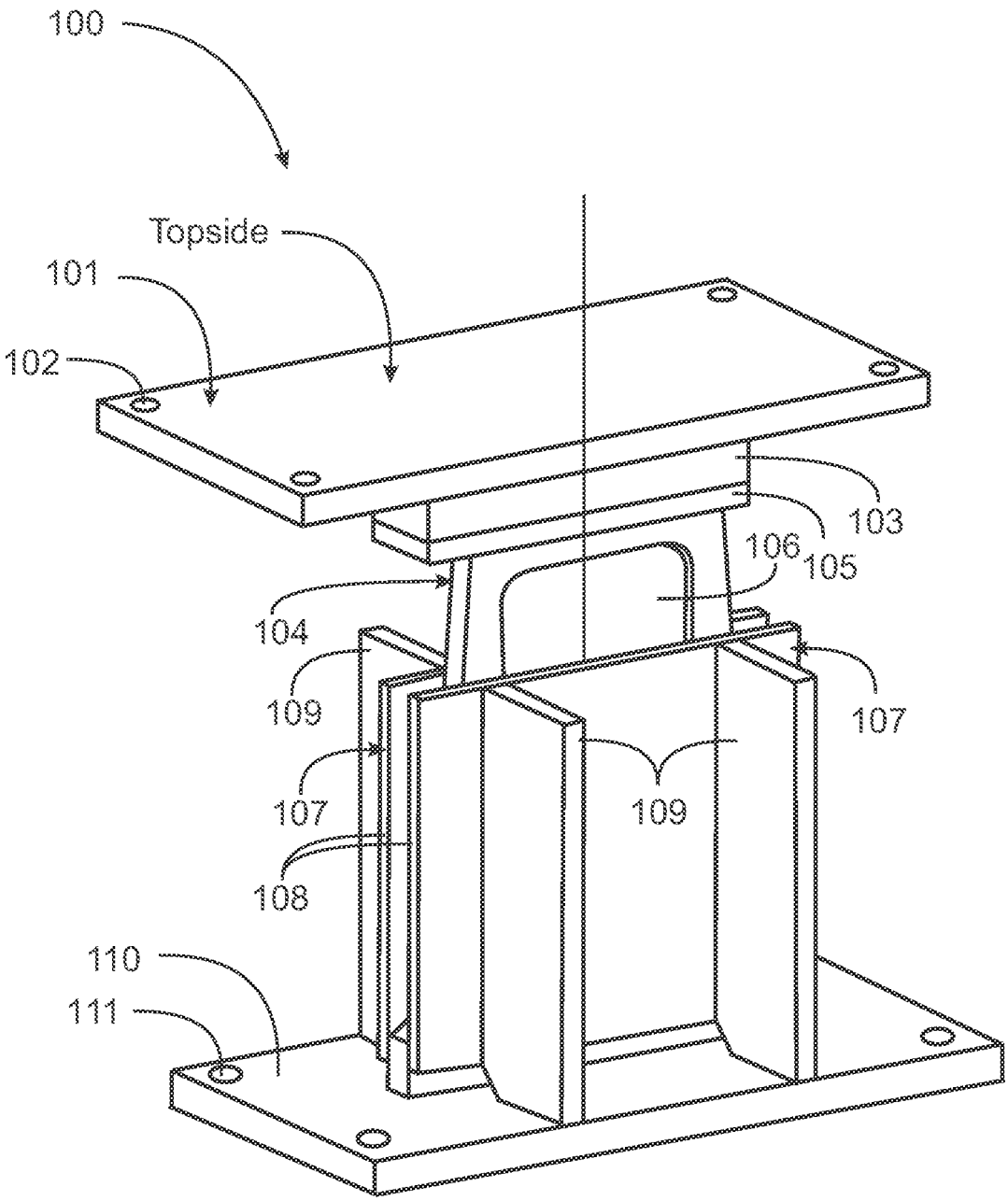
FIG. 1 is a perspective view of a buckling delayed shear link (BDSL) in one embodiment of the invention.

FIG. 1 is a perspective view of a buckling delayed shear link (BDSL) 100 in one embodiment of the invention. The BDSL in this example comprises an upper base plate 101 having and a lower base plate 110 between which active elements of the BDSL are implemented. The base plates have in this example holes 102 and 111 by which the upper base plate is joined securely to a concrete beam and the lower base plate is securely joined to a wall of a structure that includes the beam. The BDSL acts to absorb and dissipate shear forces resulting from a seismic event while preventing transfer of any axial forces or moment, as is described in enabling detail below.

A core plate 104 is an active element that absorbs shear and dissipates energy. The core plate is a planar metal plate arranged vertically in the assembly of the BDSL and joined securely at a lowermost central point to the lower base plate 110 such as by welding. Core plate 104 is joined to upper base plate 101 through an arrangement that implements a toothed plate 105 as a part of the core plate and an acceptance plate 103 having sliding openings for the teeth of the toothed plate in a manner that relative axial movement between the core plate and the upper base plate transfers no force and bending moment. This arrangement is described in enabling detail below.

Shear forces imposed on the BDSL by movement of upper base plate 101 resulting from a seismic event are dissipated by controlled deformation of core plate 104. Core plate 104 in different embodiments has one or more milled areas, such as area 106 shown, that reduce the thickness of the core plate in the milled areas.

To avoid buckling and permanent deformation of core plate 104 in use, two vertical metal restrainer plate assemblies 107 with vertically-oriented restrainer plates 108 are positioned, with the restrainer plates one on each side of core plate 104 parallel to the front and back planar surfaces of the core plate, and very close to the core plate surfaces. The surfaces of the core plate and of the restrainer plates are smoothed and polished to reduce friction as much as practical as the core plate moves between the restrainer plates. The restrainer plates in assemblies 107 are buttressed by reinforcement panels 109 that are securely joined to the restrainer plates and to the lower base plate such as by welding. The restrainer plates are shown in FIG. 1 at a height that exposes an upper portion of the core plate, but in some embodiments the restrainer plates extend to nearly the upper toother plate 105.

Figure 2:
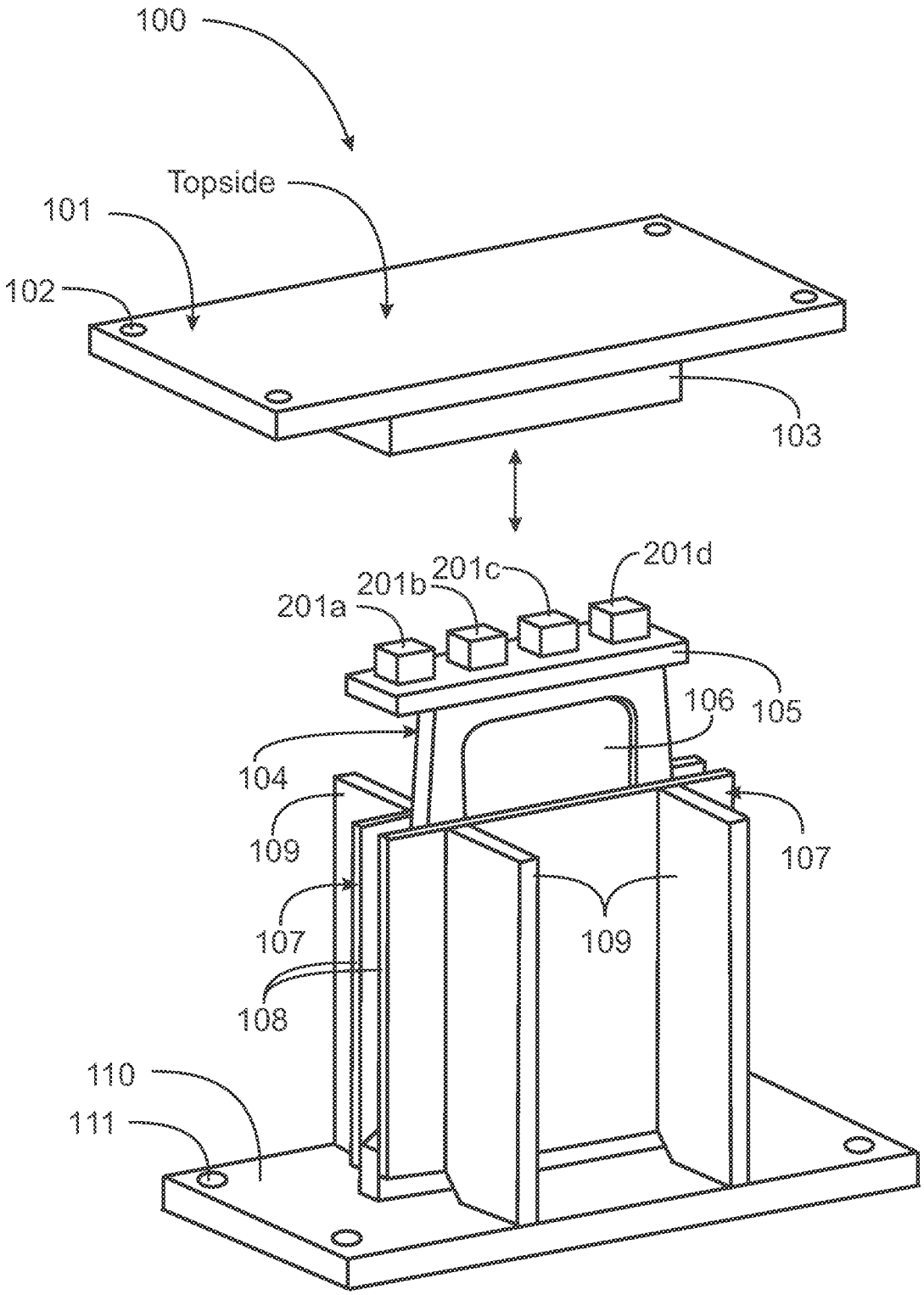
FIG. 2 illustrates the BDSL of FIG. 1 with the upper base plate assembly lifted off of the core plate in an embodiment of the invention.

FIG. 2 illustrates the BDSL of FIG. 1 with the upper base plate 101 lifted off of the core plate in an embodiment of the invention illustrating the toothed nature of the upper region of the core plate. In FIG. 2 four rectangular tooth extensions 201*a*, 201*b*, 201*c* and 201*d* are shown extending upward from toothed plate 105. These teeth engage by slip fit rectangular openings in acceptance plate 103.

Figure 3:
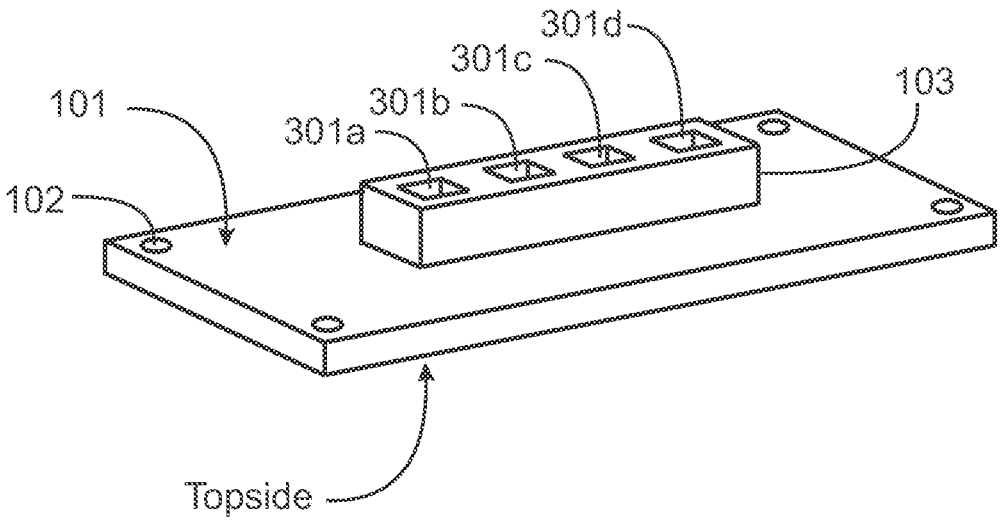
FIG. 3 is a perspective view of upper core plate 101 flipped over in an embodiment of the invention.

FIG. 3 is a view of upper base plate 101 with acceptance plate 103 overturned from the aspect of FIG. 2, to show four rectangular channels 301*a*, 301*b*, 301*c* and 301*d* implemented into acceptance plate 103 to a depth substantially greater than the height of teeth 201*a*, 201*b*, 201*c* and 201*d* extending from toothed plate 105. The positioning of the channels in acceptance plate 103 is identical to the positioning of the teeth on toothed plate 105. Returning to FIG. 2, replacing upper base plate 101 onto the core plate 104 results in the teeth entering the channels, which are marginally larger in dimension than the teeth. The arrangement is such that no axial forces and bending moments may be transferred to the BDSL by movement of upper plate 101 in a seismic event. Only shear forces are transferred at plate 103.

In the example illustrated there are four teeth and four channels, and the teeth and the channels are rectangular or square in horizontal cross section. Rectangular teeth and channels are implemented preferably because the side planes of the teeth and channels are capable of transferring higher forces than if the channels and teeth were, for example cylindrical. The invention is not limited to four channels and mating teeth, as in other embodiments there may be one of each or several more than four, and the channels and teeth may be arranged in any geometric pattern as long as the patterns match and the teeth engage the channels properly. In some embodiments the upper edges of the teeth may be chamfered to aid in engaging teeth to channels. The structure of the plates with teeth and channels provides an axial relief assembly allowing the BDSL device to eliminate transfer of axial forces.

Figure 4A:
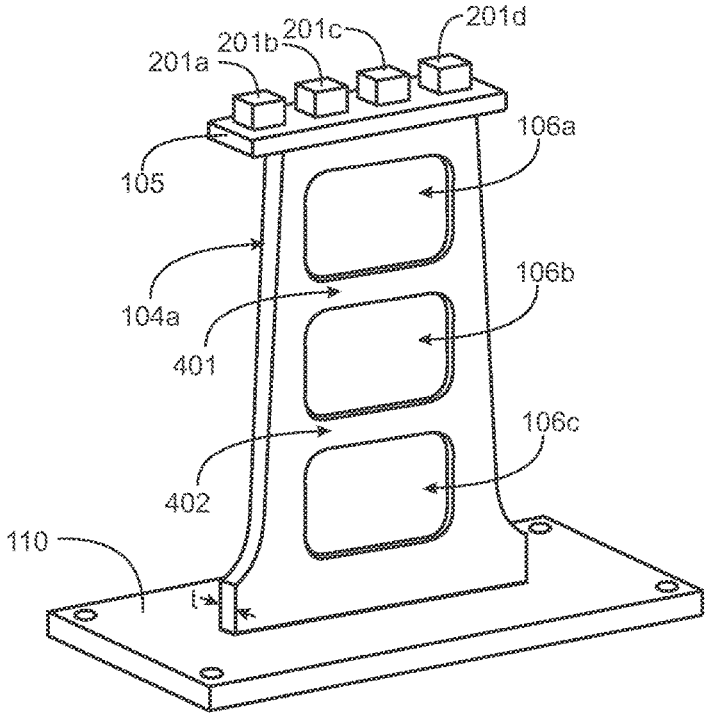
FIG. 4A is a perspective view of the core plate of FIG. 2 on the lower base plate in an embodiment of the invention.

FIG. 4A is a perspective view of a core plate 104*a* joined to lower base plate 110, such as by welding, with the restraining assemblies 107 removed to illustrate the nature of the core plate with milled areas 106. In this example there are three milled areas 106*a*, 106*b* and 106*c* on one side of core plate 104. Not seen in FIG. 4A are three more milled areas on the opposite side of core plate 104. A thickness of the core plate is indicated as t in FIG. 4A.

Figure 4B:
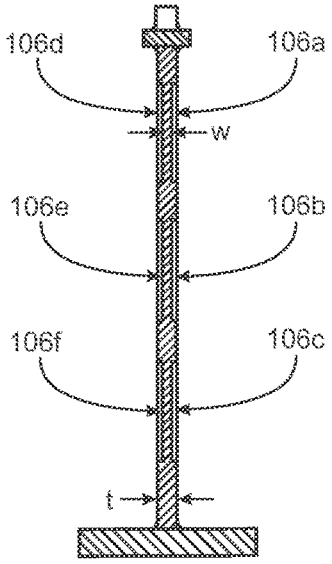
FIG. 4B is a section of the core plate of FIG. 4A in an embodiment of the invention.

FIG. 4B is a section of core plate 104 and lower base plate 110 taken down the center of core plate 104 bisecting the milled areas, to better describe characteristics and function of the core plate. It may be seen in FIG. 4B that milled areas 106*a* and 106*d* result in a web of thickness w substantially less than thickness t of the rest of the core plate. Milled areas 106*b* and 106*e* result in another web of thickness w and milled areas 106*c* and 106*f* result in a third web of thickness w. Thickness w will vary in different embodiments according to design specifications requirements for energy dissipation in a structure. The implementation of three milled areas on one side of core plate 104 also results in two spans 401 and 401 (FIG. 4A) between the milled areas of thickness t. In operation these spans help to control deformation of the webs in the milled areas, which is the characteristic of the core plate that dissipated energy for movement in a seismic event.

Figure 5A:
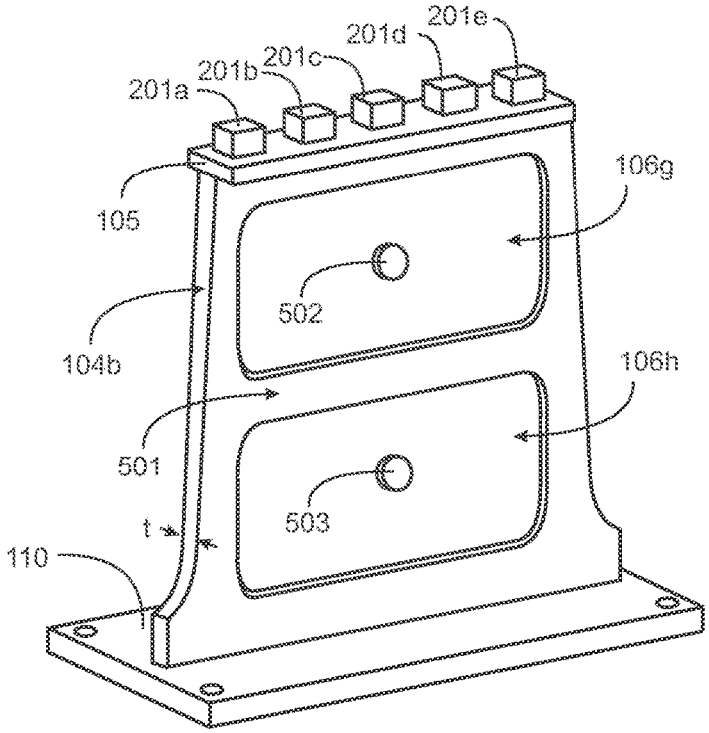
FIG. 5A is a perspective view of another core plate in an embodiment of the invention.

FIG. 5A is a perspective view of another core plate 104*b* in an embodiment of the invention. Core plate 104*b* is wider than core plate 104*a* of FIG. 4A and may be taller as well, and also may have a greater thickness that core plate 104*a*. There are five teeth on core plate 104*b* arranged in a row. There may be more or fewer teeth of different sizes and arranged in a different pattern as well. There are two milled areas 106*g* and 106*h* on one side of core plate 104*b* resulting in one span 501. Within the milled areas are buttons 502 and 503, which are projections from the web of the milled areas formed by the milling process. The outer surface of these projections extend to the original surface of the core plate prior to milling, and these button projections further aid in controlling deformation of the webs under varying load through their contact to plates 108 (see FIG. 5C).

It is to be noted that the button projections 502 and 503 are just one example of such projections and are shown substantially in the middle of the milled areas. In other embodiments there may be more than one such button projection in a milled area and the placement may be different.

Figure 5B:
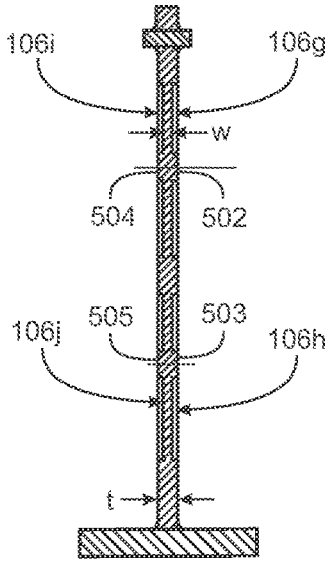
FIG. 5B is a section of the core plate of FIG. 5A in an embodiment of the invention.

FIG. 5B is a section view of the core plate of FIG. 5A illustrating the two milled areas 106*g* and 106*h* on one side, and also two milled areas 106*i* and 106*j* on the opposite side of core plate 104*b*. It is seen that the buttons project to the original surface (before milling) of the core plate.

Figure 5C:
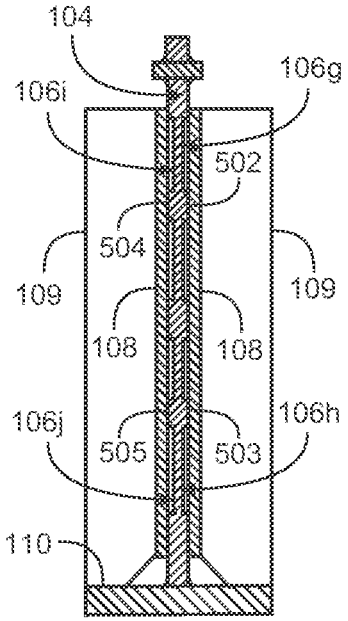
FIG. 5C is a section of a core plate in another embodiment of the invention.

FIG. 5C is a section view of the core plate of FIG. 5A with the restraining plate assemblies 107 in place and secured to the lower base plate 110. The section view is through the restraining assemblies and plates 108 as well as through the core plate. It may be seen in FIG. 5C that the button projections 502, 503, 504 and 505 contact the inside surfaces of the restraining plates 108. The buttons, proceeding from the web of material within the milled areas serve to constrain buckling of the webs in the milled areas.

Figure 5D:
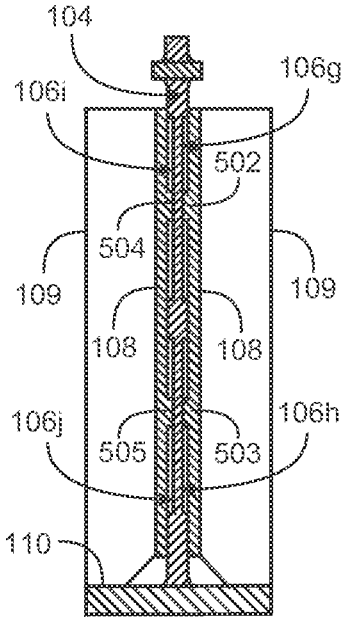
FIG. 5D is a section of a core plate in yet another embodiment of the invention.

FIG. 5D is another section view through the core plate and the restraining plate assemblies in yet another embodiment of the invention. In this embodiment the buttons are no longer on the web in the milled areas but are implemented on the restraining plates to bear upon the web in the milled area. The result in either circumstance is the same. As the BDSL device absorbs forces imposed by a seismic event the shear component of such forces bears in a cantilever fashion on the core plate that is joined such as by welding to the lower base plate. This force distorts the core plate and particularly the webs in the milled areas, and it is this distortion that absorbs the energy of the forces, which is degraded ultimately to heat. The application of the restraining assemblies serves to restrain the core plate from unwanted distortion and damage.

Another option to prevent local buckling of the milled areas is to fill the milled areas with a rubber-like material that will work as an interface that contacts thewebs in the milled areas of the core plate and the surfaces of the restraining plates 108, constraining off plane deformations of the webs. This material preferably will be hard enough to compress, to transfers all stress generated through the off plane deformation of the webs to the restraining plates 108.

Figure 6:
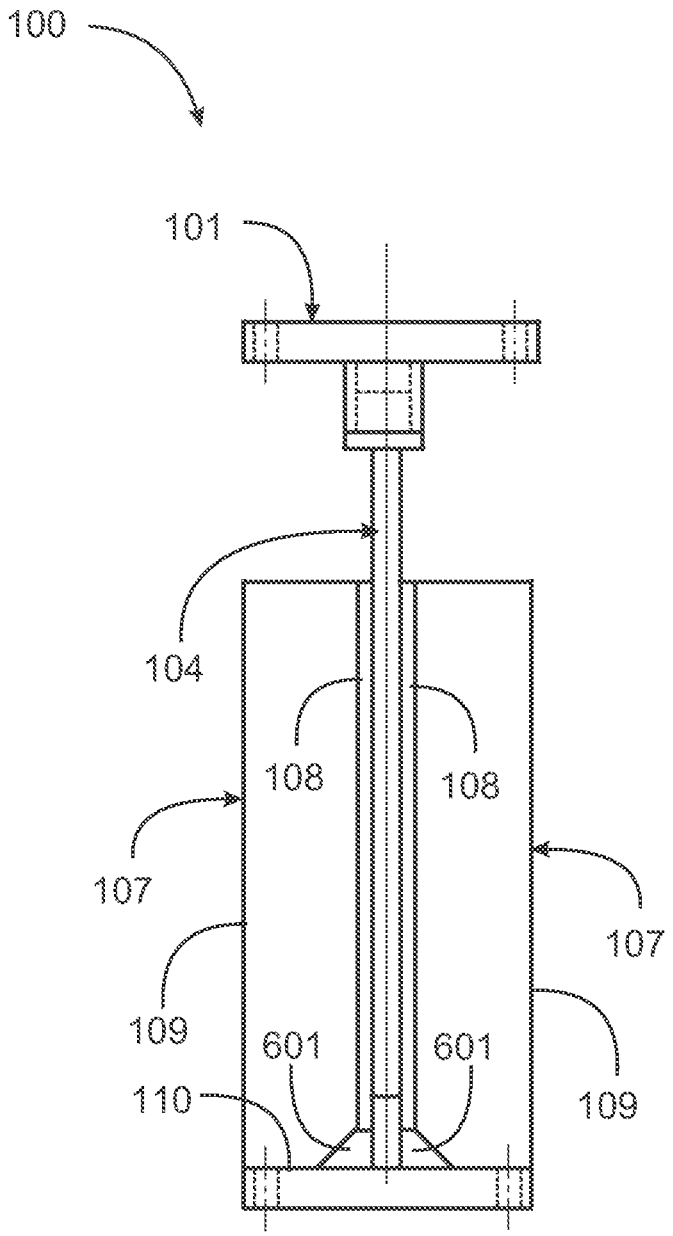
FIG. 6 is a side elevation view of the device of FIG. 4A in an embodiment of the invention.

FIG. 6 is a side elevation view of the BDSL of FIG. 1 to better illustrate the nature of the restrainer plate assemblies 107. Each restrainer plate assembly comprises a plate 108 that is positioned very close to core plate 104 and two buttress plates 109 that serve to reinforce the restrainer plates 108. FIG. 6 shows two relieved areas 601 and the actual restrainer plates joined to the buttress plates at a point about 30 mm. above the top surface of the lower base plate 110. This arrangement is to enable cleaning any dust or debris that might fall from the interface between the restrainer plates and the opposite surfaces of the core plate to be swept away by, for example, an air jet. In this way, the sedimentation of dust that can increase friction in the device if it is not properly maintained is avoided. Furthermore, the interface between the core plate and the restrainer plates may have a high-viscosity, low-friction materialin order to dissipate additional energy and, more important, delaying local and web buckling of core plate 106.

In different embodiments BDSL devices according to the invention can measure from 25 cm to 100 cm or more in height, with 50 cm being an average height. The core plate will preferably be made of steel or stainless steel, although aluminum or other materials have also proven to be good at dissipating energy by shear forces and may be used in some embodiments. For a device of average dimensions, the height-to-width ratio of the device will typically be close to 1, making devices square and shear predominant. The dimensions of the milled windows, web thickness and area will depend on the force expected to be encountered.

In various embodiments of the invention the core plates may vary in height and width and thickness and may have different numbers of milled areas with different web thickness. These characteristics will vary depending on forces expected to be encountered and energy to be dissipated.

Figure 7A:
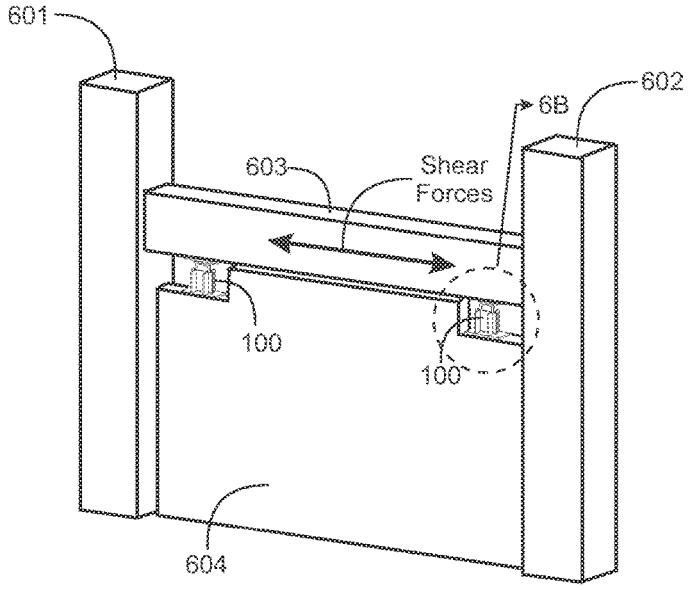
FIG. 7A illustrates implementation of BDSL devices in a building structure in an embodiment of the invention.

FIG. 7A illustrates a portion of a building structure consisting of two vertical reinforced concrete columns 601 and 601 spanned by a concrete beam 603 with an uncoupled wall 604 between the columns. In this example of applying the BDSL devices to a structure, the wall is not physically in contact with the column or the beams and may move relative to both. The upper edges of the wall are shaped with notches to provide space for implementing two BDSL devices 100 between the beam and the wall and a gap is required between the columns 601, 602 and the uncoupled wall 604. One device 100 is shown in this example installed in each notch, with the lower base plate of each fastened securely to an upper edge of the notch in the wall and the upper base plate of each fastened securely to the underside of the beam.

Figure 7B:
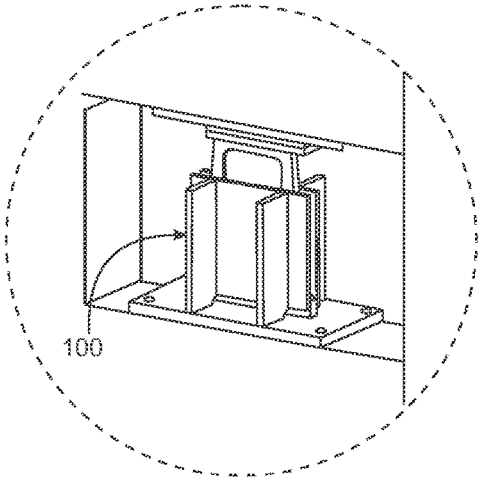
FIG. 7B is a magnified view of implementation of one device from FIG. 7A.

One device 100 between the wall and the beam is shown magnified in FIG. 7B. In a seismic event the column and beam structure experiences random movement induced by the earth movement. No axial components of movement or forces are transferred to the wall through the BDSL device by virtue of the tooth-engaging channels nature of the core plate connection to the upper base plate (see FIGS. 1-3 and description). Shear movement and resulting forces are transferred from the beam to the BDSL device by the sides of the teeth in the channels. A component of the shear forces will be parallel to the vertical surfaces of the core plate and will result in lateral deformation of the core plate, and particularly the web or webs in the core plate in the milled area or areas. All of the deformations of the core plate serve to dissipate energy, but the dissipation is particularly efficient in the webs of the milled areas. The end result of the dissipation of the energy is heating of the materials in the BDSL device.

Figure 8A:
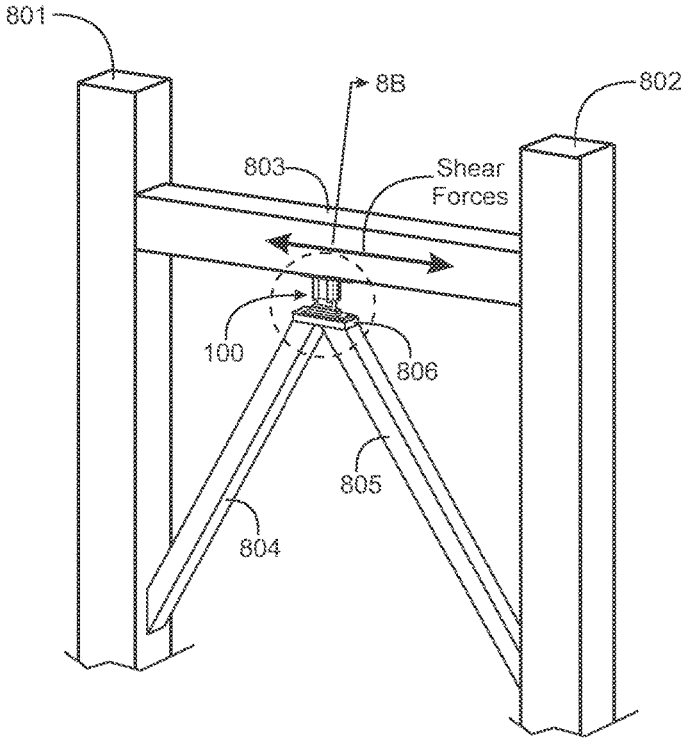
FIG. 8A illustrates implementing BDSL devices in a building structure in another embodiment of the invention.
Figure 8B:
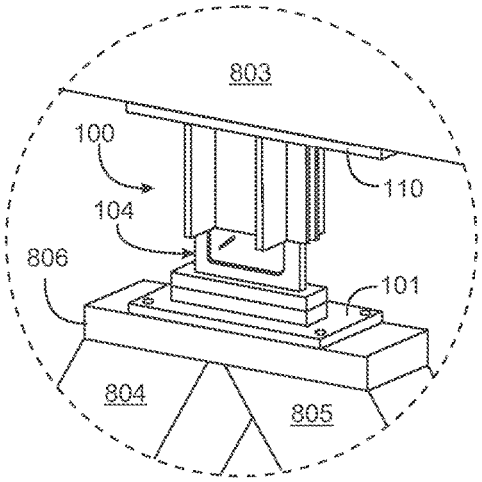
FIG. 8B is a magnified view of a BDSL device in FIG. 8A.

It will be apparent to the skilled artisan that the arrangement shown in FIGS. 7A and 7B is just one example of how the BDSL devices of the invention may be implemented in a building structure. FIGS. 8A and 8B illustrate an alternate way to integrate BDSL devices into a building structure.

FIG. 8A illustrates an alternative way to mount BDSL devices in embodiment of the invention. In FIG. 8A a portion of a concrete or steel building structure is shown comprising two vertical reinforced concrete columns 801 and 802 spanned by a concrete beam 803 with two steel diagonals 804 and 805 between the columns. This arrangement is known in the art as Chevron diagonals. The steel diagonals are anchored at a lower point to inside surfaces of the vertical columns, and in a conventional installation meet under the beam 803, providing vertical support for the beam.

In the example of FIG. 8A the diagonals do not extend to the underside of the beam, but are caused to meet at a lower point, with a platform 806 at the intersection for supporting a BDSL device in an embodiment of the present invention. A BDSL device according to an embodiment of the invention in this example must be mounted upside down from the aspect shown in, for example, FIG. 1. So the upper base plate in FIG. 1 becomes a lower base plate in FIGS. 8A and 8B, and the lower base pate becomes an upper base plate.

The BDSL device 100 between the chevron diagonals and the beam is shown magnified in FIG. 8B. In a seismic event the column and beam structure experiences random movement induced by the earth movement. Between the beam and the diagonal Chevron joint no axial components of forces may be transferred because of the nature of the connection between the core plate and the acceptance plate 103. The axial force in the diagonals is limited to the vectorial decomposition of forces through the maximum capacity of the devices. Consequently, this particular BDSL arrangement avoids buckling in the Chevron diagonals since their maximum axial force is securely limited by the device maximum capacity. Furthermore, the maximum shear force in the BDSL is precisely known by modifying the web milled thickness according to the results for a tensile plate test for the base material selected for manufacturing. The Chevron diagonal and the BDSL device together comprise a serial springs system where the forces among them are exactly the same and limited by the BDSL device, without axial force in the device Shear movement and resulting forces are transferred from the beams to the BDSL device by the sides of the teeth in the channels of the BDSL device. A component of the shear forces is parallel to the vertical surfaces of the core plate and results in lateral deformation of the core plate, and particularly the web or webs in the core plate in the milled area or areas. All of the deformations of the core plate serve to dissipate energy, but the dissipation is particularly efficient in the webs of the milled areas. The end result of the dissipation of the energy is heating of the materials in the BDSL device.

It will be apparent to the skilled artisan that the embodiments and examples illustrated and described here are entirely exemplary, and that there may be many alterations within the scope of the invention. The scope of the invention is limited only by the claims.

The invention claimed is:

1. A buckling delayed shear link (BDSL) comprising:

a first horizontal metal base plate having a length, a width, a thickness and first and second horizontal parallel surfaces;

a second horizontal metal base plate having a length, a width, a thickness and first and second horizontal parallel surfaces;

a single, metal core plate having a width, a length, a thickness between first and second parallel surfaces, rigidly joined orthogonally to the second horizontal metal base plate, presenting the first and second parallel surfaces of the single, metal core plate vertically;

an axial relief assembly having a first horizontal plate with a plurality of vertical extensions each having a specific horizontal cross section in common and a second horizontal plate with a plurality of vertical channels, equal in number to the plurality of vertical extensions, each vertical channel having the specific horizontal cross section, the plurality of vertical extensions engaged in the plurality of vertical channels, with one of the first and the second horizontal plates joined rigidly to an underside of the first horizontal metal base plate, and the other of the first and the second base plates joined rigidly to an upper edge of the single, metal core plate;

a first restraining assembly having a first vertically oriented planar restraining plate with a first surface parallel to and contacting the first parallel surface of the single, metal core plate, and a first buttress plate joined rigidly by a vertical edge orthogonally to the first vertically oriented planar restraining plate and by a lower edge to the first horizontal parallel surface of the second horizontal metal base plate; and a second restraining assembly having a second vertically oriented planar restraining plate with a second surface parallel to and contacting the second parallel surface of the single, metal core plate, and a second buttress plate joined rigidly by a vertical edge orthogonally to the second vertically oriented planar restraining plate and by a lower edge to the first horizontal parallel surface of the second horizontal metal base plate;

wherein the first horizontal metal base plate is enabled to move vertically freely over a distance relative to the second horizontal metal base plate, the single, metal core plate, and the first and second restraining assemblies by virtue of the axial relief assembly, and lateral movement of the first horizontal metal base plate relative to the second horizontal metal base plate transfers a shear component of force to an upper end of the single, metal core plate.

2. The BDSL of claim 1 further comprising a first milled area of a specific shape to a first depth on the first parallel surface of the single, metal core plate and a second milled area of the same specific shape and depth on the second parallel surface of the single, metal core plate, resulting in a web of the specific shape, having the thickness of the single, metal core plate less twice the depth of the first and second milled areas.

3. The BDSL of claim 2 comprising two or more webs in milled areas at different locations on the single, metal core plate.

4. The BDSL of claim 2 further comprising a first button extension from the web on one side of the web, presenting a flat surface contacting the first surface of the first vertically oriented planar restraining plate, and a second button extension on an opposite side of the web, presenting a flat surface contacting the second surface of the second vertically oriented planar restraining plate, restraining the web from local buckling deformation.

5. The BDSL of claim 4 further comprising additional button extensions on opposite sides of different webs of the single, metal core plate, each extending a flat surface contacting the first or second surfaces of the first or the second vertically oriented planar restraining plates.

6. The BDSL of claim 2 further comprising a first button extension from the first vertically oriented planar restraining plate extending into the first milled area, presenting a flat surface contacting a first surface of the web, and a second button extension from the second vertically oriented planar restraining plate extending into the second milled area, presenting a flat surface contacting a second surface of the web, the button extensions from the first and second vertically oriented planar restraining plates restraining the web from buckling deformation.

7. The BDSL of claim 6 further comprising additional button extensions on surfaces of the first and second vertically oriented planar restraining plates, each extending a flat surface contacting the first or second surfaces of the webs.

8. The BDSL of claim 2 further comprising a material filling the first and second milled areas from the web, presenting flat surfaces contacting the first or the second surfaces of the first and the second vertically oriented planar restraining plates, the filling material serving to delay the web from buckling deformation.

9. The BDL of claim 8 wherein the material is one of neoprene or lead.

10. The BDSL of claim 1 wherein the axial relief assembly comprises a first horizontal plate with a plurality of vertical extensions each having a specific horizontal cross section, and a second horizontal plate with a plurality of vertical channels, equal in number to the plurality of vertical extensions, each channel having a horizontal cross section identical to the cross section of the vertical extensions of the first horizontal plate, with the plurality of vertical extensions engaged in the plurality of vertical channels, with one of the first and the second horizontal metal plates joined rigidly to an underside of the first horizontal metal base plate, and the other of the first and the second horizontal metal base plate joined rigidly to an upper edge of the single, metal core plate.

11. The BDSL of claim 1 wherein the metal of the single, metal core plate is either stainless steel or aluminum.

12. The BDSL of claim 1 further comprising a plurality of buttress plates in each restraining assembly, the buttress plates rigidly joined to the second horizontal metal base plate and to the first and the second vertically oriented planar restraining plates in a manner that the first and the second vertically oriented planar restraining plates are held above the second horizontal metal base plate, providing clearance for cleaning.

13. A method for dissipating energy in a building structure in a seismic event, comprising:

creating a buckling delayed shear link (BDSL) device having a first metal base plate having a length and a width in a horizontal plane and first and second parallel horizontal surfaces, a second metal base plate having a length and a width in a horizontal plane and first and second parallel horizontal surfaces, a single metal core plate having a width, a length and a thickness between first and second parallel surfaces, rigidly joined orthogonally to the second metal base plate, an axial relief assembly having a first horizontal plate with a plurality of vertical extensions having a specific horizontal cross section in common and a second horizontal plate with a plurality of vertical channels equal in number to the plurality of vertical extensions, each vertical channel having a horizontal cross section identical to the horizontal cross section of the vertical extensions of the first horizontal plate, the vertical extension extensions engaged in the vertical channels, one of the first and the second horizontal plates joined rigidly to an underside of the first metal base plate, and the other of the first and the second base plates joined rigidly to an upper end of the single metal core plate, a first restraining assembly having a first vertically oriented restraining plate with a first surface contacting the first parallel surface of the single metal core plate, and a first buttress plate joined rigidly by a vertical edge orthogonally to the first vertically oriented restraining plate and by a lower edge to the first parallel horizontal surface of the second metal base plate, and a second restraining assembly having a second vertically oriented restraining plate with a second surface contacting the second parallel surface of the single metal core plate, and a second buttress plate joined rigidly by a vertical edge orthogonally to the second vertically oriented restraining plate and by a lower edge to the first parallel horizontal surface of the second metal base plate; and installing the BDSL device between structural members of a building, the first metal base plate of the BDSL device joined rigidly to one of the constituent structural members and the second metal base plate joined rigidly to the other of the structural members, such that the first metal base plate is enabled to move vertically freely over a distance relative to the second metal base plate, the single metal core plate, and the first and second restraining assembly by virtue of the axial relief assemblies assembly, and lateral movement of the first metal base plate relative to the second metal base plate transfers a shear component of forces to an upper end of the single metal core plate.

14. The method of claim 13 further comprising, machining a first milled area of a specific shape to a first depth on the first parallel surface of the single metal core plate, and machining a second milled area of the specific shape and depth directly on the second parallel surface of the single metal core plate, resulting in a web of the specific shape, having a thickness of the single metal core plate less twice the first depth of the milled areas.

15. The method of claim 14 further comprising filling the first and the second milled areas, presenting flat surfaces contacting the first and the second restraining plates.

16. The method of claim 15 comprising filling the first and the second milled areas with one of neoprene or lead.

17. The method of claim 14 further comprising creating two or more webs by machining milled areas at different locations on the first and second parallel surfaces of the single metal core plate.

18. The method of claim 14 further comprising forming a first button extension from the web on one side of the web presenting a flat surface coplanar with the first parallel surface of the single metal core plate and forming a second button extension of from the web presenting a flat surface coplanar with the second parallel surface of the single metal core plate.

19. The method of claim 17 further comprising forming additional button extensions on opposite sides of different webs of the single metal core plate, each extending a flat surface coplanar with the first or second parallel surfaces of the single metal core plate.

20. The method of claim 14 further comprising forming a first button extension from the first surface of the first vertically oriented restraining plate, extending into the first milled area, presenting a flat surface contacting the web, and forming a second button extension from the second surface of the second vertically oriented restraining plate extending into the second milled area, presenting a flat surface contacting the web.

21. The method of claim 20 further comprising forming additional button extensions on the first and the second surfaces of the first and the second vertically oriented restraining plate, each extending a flat surface contacting the web.

22. The method of claim 13 comprising implementing the axial relief assembly with a first horizontal plate having a plurality of vertical extensions each having a specific horizontal cross section and a second horizontal plate with a plurality of vertical channels, equal in number to the plurality of vertical extensions, each channel having the specific horizontal cross section, engaging the vertical extensions in the vertical channels, and joining one of the first and the second horizontal plates rigidly to an underside of the first metal base plate, and joining the other of the first and the second horizontal plates rigidly to an upper edge of the single metal core plate.

23. The method of claim 13 comprising making the single metal core plate from either stainless steel or aluminum.

24. The method of claim 13 further comprising implementing a plurality of buttress plates in the first and the second restraining assembly, the buttress plates rigidly joined to the second metal base plate and to the first and the second vertically oriented restraining plates in a manner that the first and the second vertically oriented restraining plates are held above the second metal base plate, providing clearance for cleaning.

25. The method of claim 13 wherein the structural members are an uncoupled wall below a concrete beam, with the first metal base plate joined rigidly to an underside of the concrete beam, and the second metal baseplate joined rigidly to an upper end of the uncoupled wall.

26. The method of claim 13 wherein the structural members are a pair of intersecting Chevron diagonal braces below a concrete beam, with the first metal base plate joined rigidly to an intersection of the Chevron diagonal braces, and the second metal base plate joined rigidly to an underside of the concrete beam.

27. The method of claim 26 wherein the pair of intersecting Chevron diagonal braces and the BDSL device comprise a serial springs system where forces are limited by the BDSL device, without axial force in the BDSL device.

* * * * *